United States Patent [19]

Paschen et al.

[11] 4,406,666

[45] Sep. 27, 1983

[54] DEVICE FOR THE GASIFICATION OF CARBON BY MEANS OF A MOLTEN METAL BATH

[75] Inventors: Peter Paschen; Chatty Rao, both of Bergisch-Gladbach; Alfred Kryczun; Roland Pfeiffer, both of Cologne; Heinz-Dieter Waldhecker, Bergisch-Gladbach; Rolf Pufal, Cologne, all of Fed. Rep. of Germany

[73] Assignee: Klöckner-Humboldt-Deutz AG, Fed. Rep. of Germany

[21] Appl. No.: 299,163

[22] Filed: Sep. 3, 1981

Related U.S. Application Data

[63] Continuation of Ser. No. 82,539, Oct. 9, 1979, abandoned.

[30] Foreign Application Priority Data

Oct. 7, 1978 [DE] Fed. Rep. of Germany ..... 2843879

[51] Int. Cl.[3] ..... C10J 3/48

[52] U.S. Cl. ..... 48/92; 266/201; 266/229; 266/245

[58] Field of Search ..... 48/92, 62 R, 73, 77, 48/76; 266/245, 247, 201, 230, 229, 215, 213, 204, 159, 145, 218, 166; 422/193, 209

[56] References Cited

U.S. PATENT DOCUMENTS

| | | | |
|---|---|---|---|
| 2,612,444 | 9/1952 | Rummel | 48/92 |
| 3,170,017 | 2/1965 | Namy | 48/92 |
| 3,650,519 | 3/1972 | Vogt et al. | 266/218 |
| 3,873,073 | 3/1975 | Baum et al. | 266/159 |
| 4,062,657 | 12/1977 | Knuppel et al. | 48/77 |

FOREIGN PATENT DOCUMENTS

| | | | |
|---|---|---|---|
| 2750725 | 5/1979 | Fed. Rep. of Germany | 48/92 |
| 2813209 | 10/1979 | Fed. Rep. of Germany | 48/92 |

OTHER PUBLICATIONS

N. Berkowitz, "Coal Gasification–A State of the Art", Review, 1973, pp. 32–33.

*Primary Examiner*—William F. Smith

*Attorney, Agent, or Firm*—Hill, Van Santen, Steadman & Simpson

[57] ABSTRACT

A device for the gasification of carbon containing material to obtain the continuous production of gas, essentially a mixture of carbon monoxide and hydrogen, by using the molten metal bath process is provided. The carbon material, oxidizing agents, and slag-forming additives as needed are introduced into a reactor below the surface of a molten metal bath. The reactor is provided with outlets for the slag, gases, and molten metal. The reactor is also provided with the ability to tilt, swivel, or rotate about a horizontal axis. This rotational movement causes the molten metal bath to alter its location within the reactor, allowing for replacement of the input apparatus of the raw materials, which are normally below the surface, without the necessity of draining the molten metal bath from the reactor.

14 Claims, 22 Drawing Figures

FIG.7
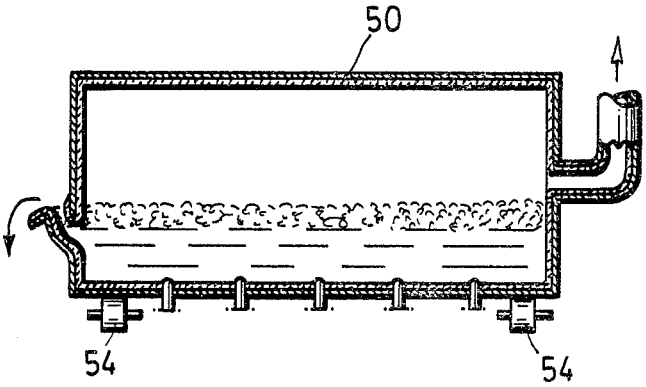
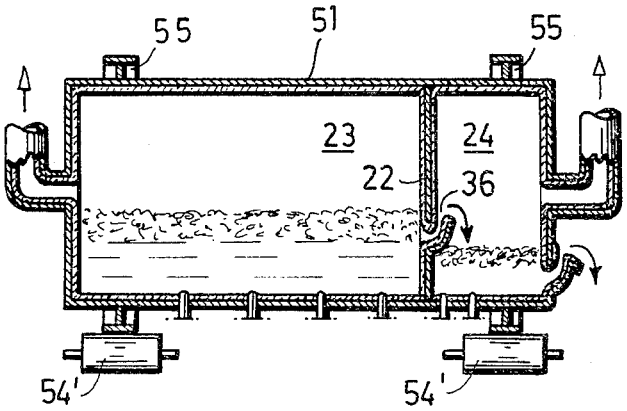
FIG.8

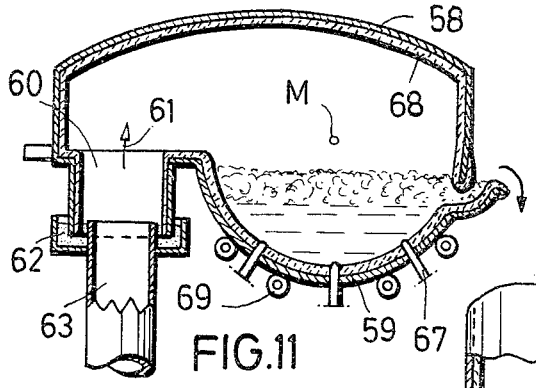
FIG.11
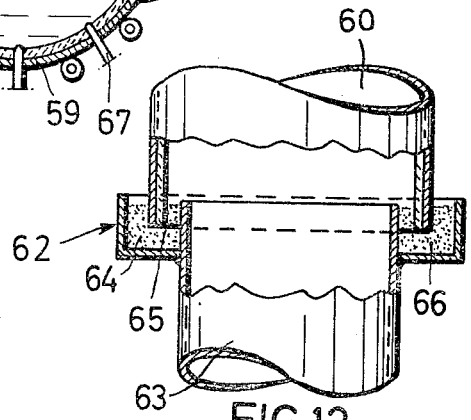
FIG.12
FIG.13
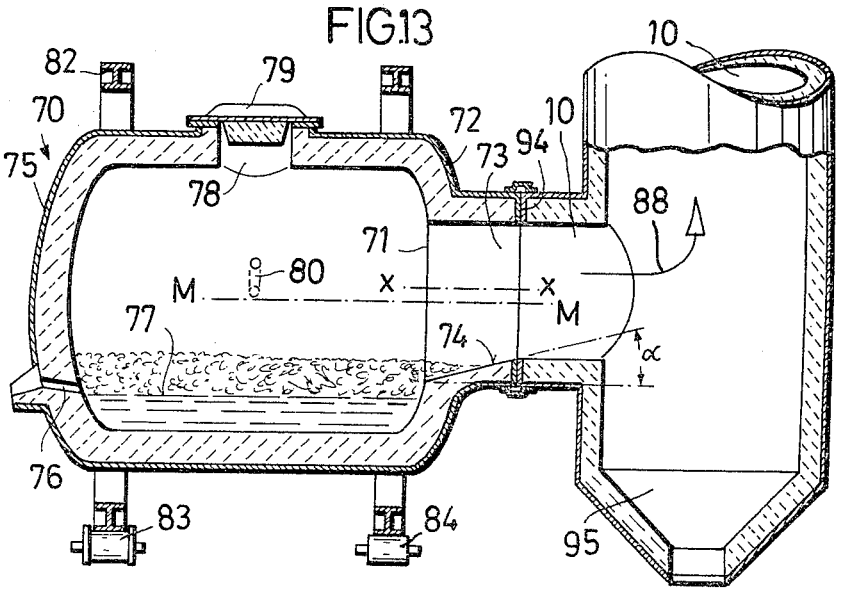

70
81
87
80
86
85
93
92

70
90
73
D
M
89
91
91

FIG. 18
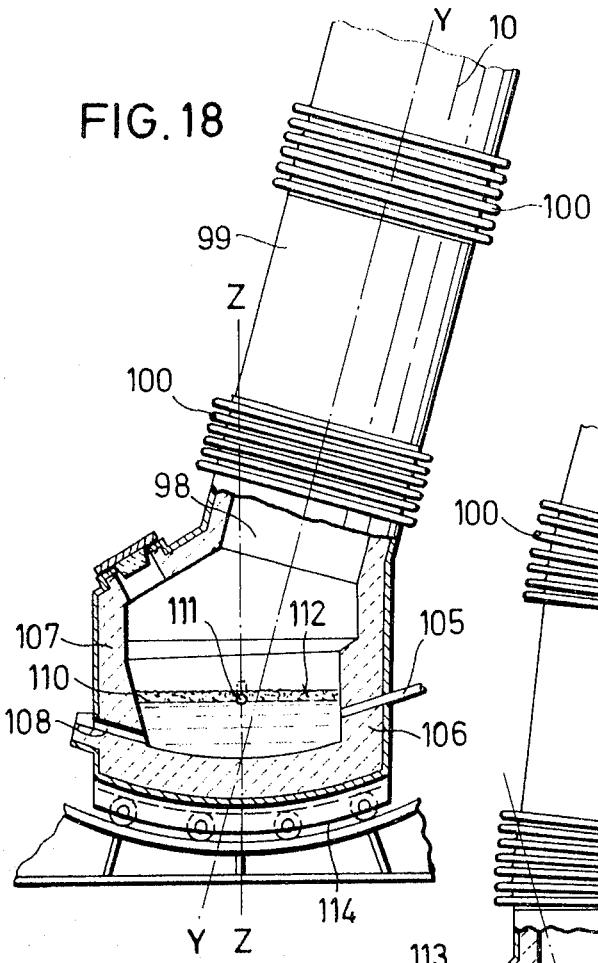
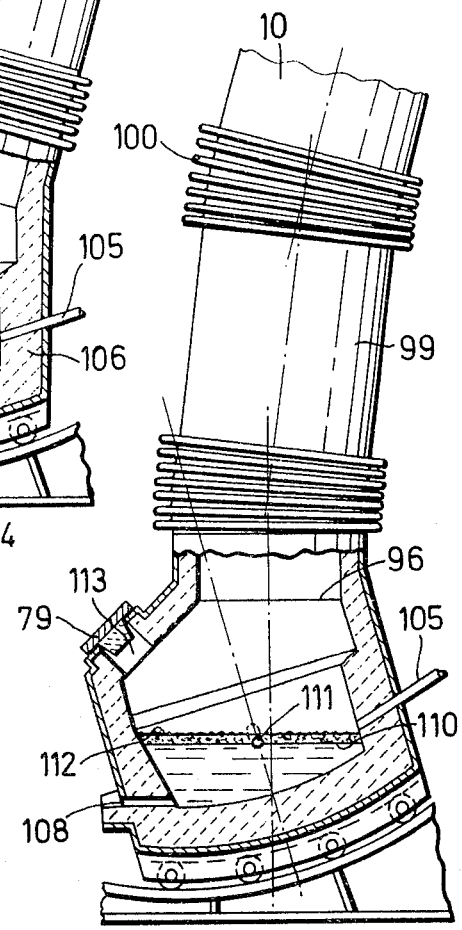
FIG. 19

DEVICE FOR THE GASIFICATION OF CARBON BY MEANS OF A MOLTEN METAL BATH

This is a continuation of application Ser. No. 082,539, filed Oct. 9, 1979 now abandoned.

BACKGROUND OF THE INVENTION

1. Field of the Invention

The present invention relates to a device for the gasification of carbon and materials containing carbon, and more particularly to such a device for the continuous production of carbon monoxide and hydrogen gasses wherein the carbon material is supplied beneath the surface of a molten metal contained in a reactor, which reactor has openings for gas discharge and at least one liquid discharge opening.

2. Description of the Prior Art

In known devices for the gasification of carbon or carbon containing materials for the production of a reaction of synthesis gas containing carbon monoxide (CO) and hydrogen ($H_2$), the carbon fuel (typically containing some amount of sulfur) and preheated air are introduced into a molten metal bath. In the German Letters Patent No. 1,915,248, carbon fuel containing sulfur and preheated air are laterally introduced into a molten iron bath, through the walls of the stationary reactor using lances.

During the operation of a stationary reactor, difficulties can arise—particularly when nozzles are arranged in the bottom area of the reactor for introduction of the carbon fuel and air instead of the lances described above. Due to the gasification process, such nozzles tend to burn or wear off, or become corroded. In order to maintain efficient reactor operation, these nozzles must be occasionally cleaned or replaced. However, in order to clean or replace a malfunctioning bottom nozzle, a stationary reactor must be taken out of operation and be emptied of its molten metal. This naturally is costly in and of itself and additionally results in the loss of a great deal of operating time. These same difficulties also ensue when repairing other damage such as washouts or corrosion of the fireproof cladding of the reactor, particularly in the area of the phase boundary.

SUMMARY OF THE INVENTION

An object of the invention thus consists of creating a device which permits the prompt elimination of disruptions of this nature occuring during operation, particularly those due or relating to bottom nozzles.

The resolution of this object is attained by providing a reactor which is arranged so as to be tiltable, swivelable, or rotatable. The advantage of such an arrangement is that the reactor need not be emptied upon the occurrence of the above described disruptions in or damage to the nozzles during operation. Instead of the previously required time consuming emptying operation the nozzles can be swiveled out of the molten metal by means of inclining the reactor, and the problem can then be corrected by either repair or replacement of the nozzles. Similarly, problems with the fireproof cladding can also be more rapidly corrected.

Due to the inventive arrangement of the reactor, the molten metal situated in the reactor need not be removed during repair. This work can then be carried out quickly and without difficulty. In comparison to known, stationary reactors for the production of CO and $H_2$ using a molten metal bath, this is accompanied by a very significant savings in terms of work, time, and costs, even given the employment of bottom nozzles.

As an advantageous co-development of the invention, quick release seals are provided at the connection between the gas discharge and the stationary gas discharge line. These allow a quick release of such connections for a rapid and uncomplicated initiation of the swivel, rotary, or tilting motion of the reactor.

Various other objects, advantages, and features of the present invention will become readily apparent from the ensuing detailed description and drawings, with the novel features particularly pointed out in the appended claims.

BRIEF DESCRIPTION OF THE DRAWINGS

FIG. 7 is a side elevation sectional view showing a reactor in the form of a horizontal cylinder embodying the present invention.

FIG. 8 is a view similar to FIG. 7 of such a reactor having two chambers.

FIG. 11 is a side elevation sectional view showing a reactor having a gas discharge shaft arranged laterally according to the present invention.

FIG. 12 is a side sectional view with portions broken away showing a sand seal between a gas discharge nozzle and a gas removal line according to the present invention.

FIG. 13 is a side elevation sectional view showing a reactor with a horizontal emission channel with a rotary seal and dust separator device.

FIG. 18 is a view similar to FIG. 17 showing the reactor tilted at an angle.

FIG. 19 is a view similar to FIG. 17 showing the reactor in another position wherein the nozzles have been swiveled out of the molten metal bath.

DESCRIPTION OF THE PREFERRED EMBODIMENTS

Figure 1:
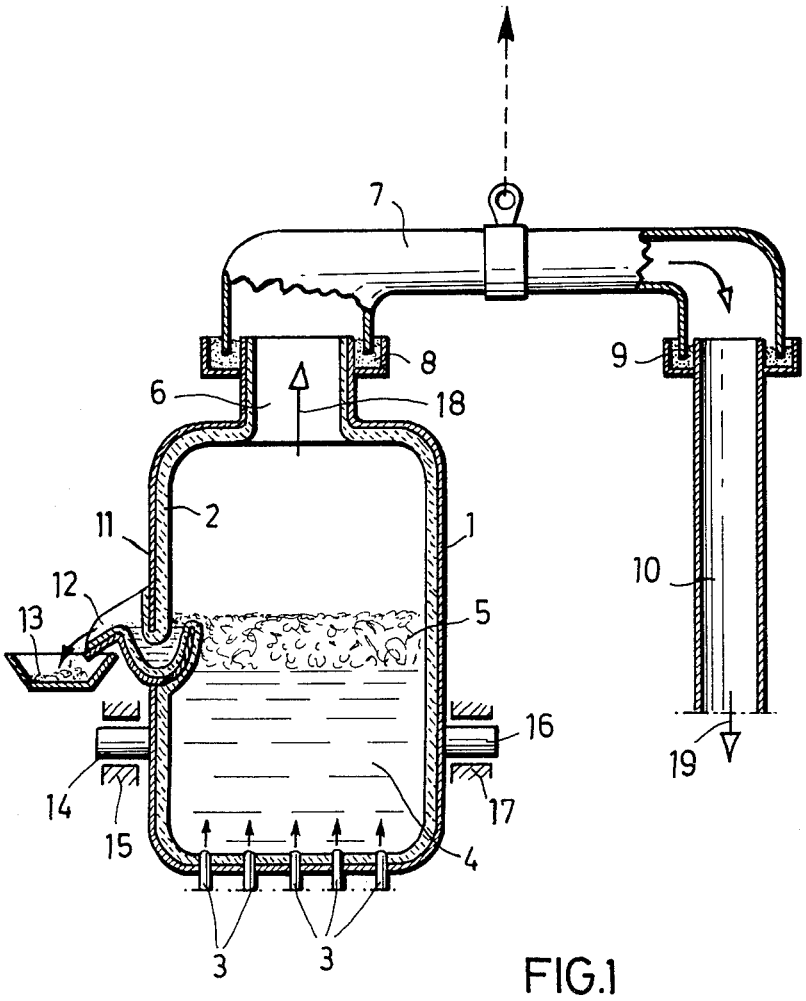
FIG. 1 is a side elevation sectional view showing a reactor in the form of a vertical cylinder according to the present invention.

FIG. 1 shows a reactor 1, designed as a vertical vessel, clad with a fireproof cladding 2 in the interior. Nozzles 3 are arranged in the bottom of the reactor 1. Through nozzles 3, carbon fuel, i.e. carbon or material containing carbon, as well as oxidizing gasification agents and, if necessary, slag-forming constituents are introduced from below into metal bath 4 situated in the reactor 1 and having a layer of slag 5 situated thereon.

In its upper region, the reactor 1 is equipped with a gas discharge 6. This discharges into a movable gas discharge channel 7 which is connected to a stationary gas discharge line 10 at the connection locations 8 and 9 so as to be easily releasable. The heat-resistant seals at the connection locations 8 and 9 are not executed in detail in the schematic illustration according to FIG. 1, but are only indicated in principle. A more detailed description of said seals follows in FIG. 12 and FIGS. 16 through 22.

On the left-hand side, the reactor 1 is provided with a slag discharge nozzle 12 arranged at the wall 11, said nozzle 12 discharging into a slag ladle 13 situated below it or being directly connected to a device (not illustrated) for the de-sulphurization and preparation of the slags. When required, this slag discharge nozzle 12 can be closed by means of a fire-clay plug. Further, the reactor 1 is provided at both sides with pivot pins 14, 16 which are held so as to be tiltable and rotatable in bearings 15, 17.

During operation of the reactor 1, the carbon materials consisting of solid, liquid or gaseous media, as well as the gasification agents consisting of oxygen or gases containing oxygen and if necessary, slag-forming constituents (for example, limestone or dolomite) are introduced in a suitable form, for example, in a fine-granular form given solids, through the nozzles 3 from below into the molten metal 4. The molten metal 4 can consist of molten iron, silicon, chromium, copper, lead, etc., or can be a smelt containing iron or, a molten iron alloy, etc. As a result of the reaction occurring at the high temperatures achieved when coming into contact with the metal 4, these carbon materials are converted in the metal bath into a reaction gas which essentially contains a mixture consisting of carbon monoxide and hydrogen, and is practically free of carbon dioxide and water vapor. The dimension of the metal melt 4 in the reactor is thereby designed such that, given a predetermined bath volume, the bath surface is a maximum with, however, the depth of the bath laid out so that not direct blow-through of the gasification agents and/or slag-forming consituents ensues. By so doing, the emergence surface for the reaction gases there-arising and the reaction time are particularly favorable.

The sulfur present in the carbon or in the carbon carrier is absorbed by the basic slag 5 situated on the metal melt 4, so that a high-grade product gas can be removed from the reactor 1 via the gas discharge channel 6 in the direction of arrows 18, 19. The slag 5 containing sulfur or a part of said slag is drawn off from time to time, after a corresponding saturation with sulfur, through the discharge nozzle 12 into the slag ladle 13. After a de-sulfurizing preparation, if necessary, the slag is again supplied to the reactor 1 through the nozzles 3 as slag forming material.

If, during the operation of the reactor 1, the nozzles 3 should become blocked or otherwise malfunction, the reactor 1 may, using the present inventive arrangement, be inclined until the nozzles 3 are free from the metal melt 4. Subsequently, depending upon the type of disruption, a nozzle 3 can be blown free, cleaned, or replaced. Since neither the metal melt 4 nor the slag 5 need be removed from the reactor 1 to do any of these acts, malfunctions with the nozzles 3 arranged in the bottom reactor area can be corrected in a very simple manner. These repairs can be performed without extensive disruptions to the operation and preferably within the shortest time and lowest possible outlay.

To this end, the movable gas discharge channel 7 is lifted off from the connection locations 8 and 9, so that the reactor 1 can be freely swiveled around the pivot pins and bearings 14, 15, 16, 17. Inventively, the connection locations 8 and 9 are designed as quick-release locations with an appropriately uncomplicated and heat-resistant seal. In the illustrated example, a sand seal is provided, which seal is filled with a loose fill of sand gained by comminution of fireproof ceramic. The difference which accompanied the creation or release of a seal in the case of a seal of rigid design, given the corresponding operating temperatures, may well have been a significant reason which up to now kept persons skilled in the art from utilizing reactors designed so as to be tiltable, swivelable or rotatable, in known molten bath reactor type processes.

Figure 2:
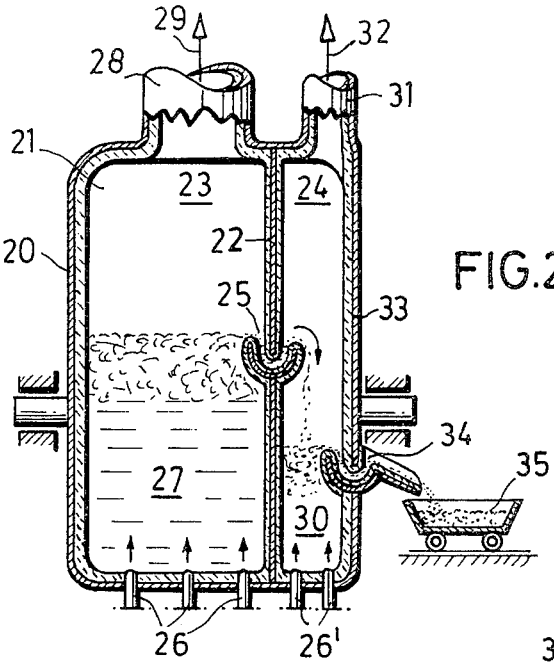
FIG. 2 is a view similar to FIG. 1 of such a reactor having two chambers.

In a reactor 20 illustrated in FIG. 2, the interior space 21 is divided into two chambers 23 and 24 by means of a vertical wall 22. The two chambers 23 and 24 are connected to one another via an opening 25 arranged in the partition wall 22. For the purpose of a gas seal, this opening 25 is syphon-like in design. Thereby, the overflow or leakage of gas from one chamber into the other is prevented by simple means. In the same manner as the reactor 1 illustrated in FIG. 1, carbon materials, gasification agents, and slag-forming constituents are introduced to the reactor 20 through bottom nozzles 26 into the metal melt 27 situated in the chamber 23. A product gas then is produced which is withdrawn toward the top via the discharge line 28 in the direction of arrow 29. Oxygen, water vapor, or a mixture consisting of both is blown through nozzles 26' into the chamber 24 which is partially filled with sulfur-saturated slag and is thus blown through the slag 30 which has a high sulfur content. The slag 30 is de-sulfurized by the emission of $SO_2$. The high-sulfur $SO_2$ gas is drawn off via the discharge nozzle 31 towards the top in the direction of arrow 32 and, for the purpose of obtaining sulfur or sulfuric acid, is subjected to an appropriate process (not shown). The oxygen and/or hydrogen can be blown on from the top through lances (not shown) for the same purpose.

De-sulfurized slag 30 is periodically drawn off from the chamber 24 into a slag ladle 35 through the slag discharge opening 34 arranged laterally in the wall 33 of the chamber 24. The slag discharge opening 34 being closable if necessary.

This reactor 20 illustrated in FIG. 2 is also arranged so as to be tiltable or rotatable, and is connected to a stationary gas line with quick-release seals (not shown). Any disruptions at the nozzles 26, 26' occurring during operation, may thereby be quickly and simply repaired or the nozzles 26, 26' may just as easily be replaced.

Figure 4:
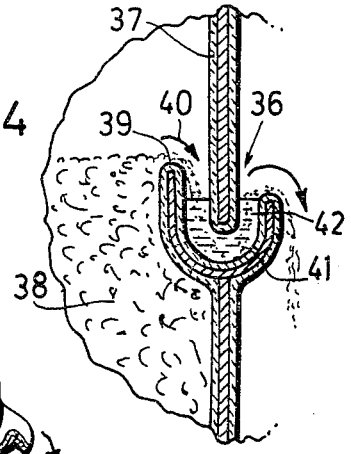
FIG. 4 is a partial sectional view showing an opening in the wall of a reactor designed as a syphon.

FIG. 4 shows in greater detail the operation of a syphon-like seal. An opening 36 is designed as a syphon in a wall 37. The slag 38 enters into the syphon 36 via the edge 39 in accord with the arrow 40. A liquid shut-off 42 in the U-pipe 41 of the syphon 36 is thus created.

Figure 3:
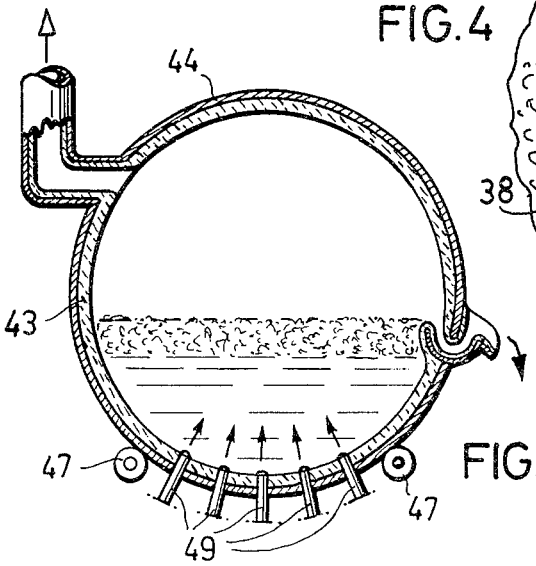
FIG. 3 is a view similar to FIG. 1 of a spherical reactor.
Figure 5:
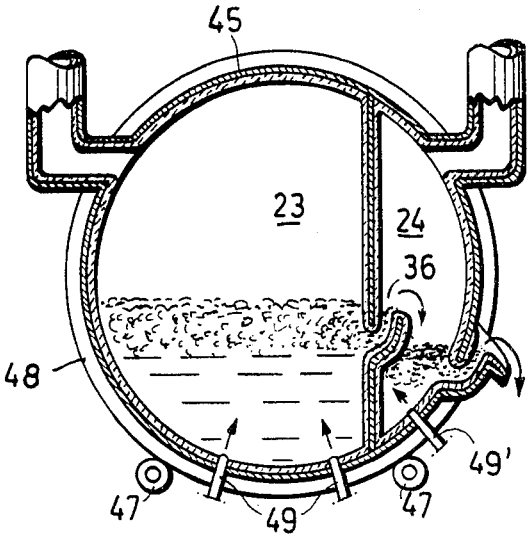
FIG. 5 is a view similar to FIGS. 1 and 2 of a spherical reactor having two chambers.
Figure 6:
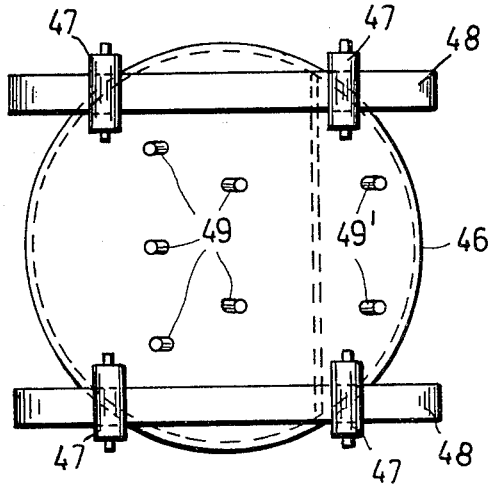
FIG. 6 is a bottom view of the reactor shown in FIG. 5.

Spherically designed reactors 44, 45, 46 with a fireproof lining 43 are illustrated in FIGS. 3, 5 and 6. These are rotatably seated on rollers 47 and ball races 48. In their manner of functioning, they correspond to the reactors 1 and 20 illustrated in FIGS. 1 and 2; the nozzles 49, 49' are arranged in the bottom and can likewise be rotated out of the metal melt as needed by means of a simple rotation or tilting of the reactor 44, 45, 46. The nozzles 49, 49' can thereby be exposed and cleaned, or be replaced without problem. An arrangement of such nozzles in the bottom area of reactor 46 is illustrated in FIG. 6, which shows the reactor according to FIG. 5 in a bottom view.

Another form of reactor is shown in FIGS. 7, 8, 9 and 10. Thereby, reactors 50 and 51 are designed approximately cylindrically and are movably seated by lying on rollers 54, 54' as well as ball races 55, if necessary. The reactor 50 illustrated in FIG. 7 is designed as a single chamber reactor, whereas the reactor 51 illustrated in FIG. 8 represents a two-chamber reactor.

Figure 9:
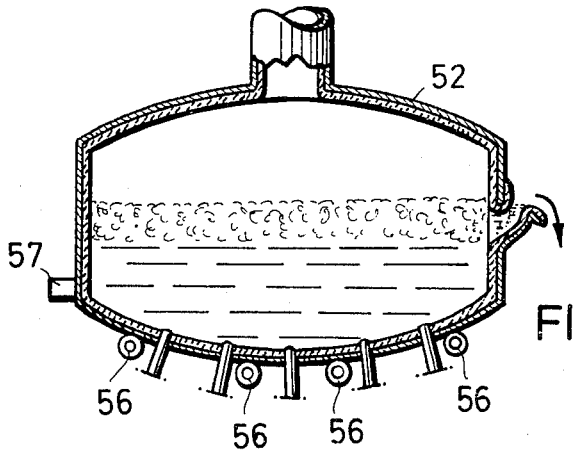
FIG. 9 is a side elevation sectional view showing a barrel-shaped reactor embodying the invention.
Figure 10:
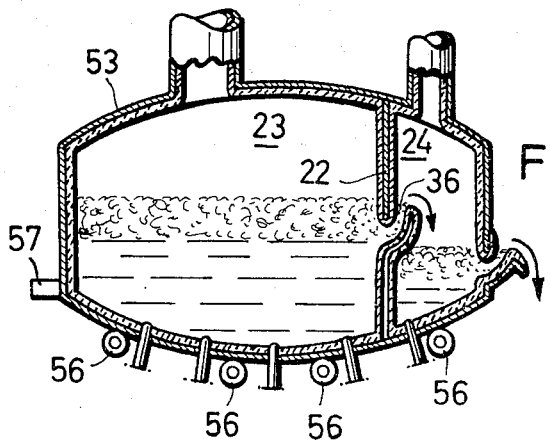
FIG. 10 is a view similar to FIG. 9 of a barrel-shaped reactor having two chambers.

As can be seen from FIGS. 9 and 10, reactors 52 and 53 can also be advantageously designed in the form of a barrel with flattened end faces. These also are tiltably and swivelably seated on rollers 56. In addition, the reactors 52, 53 are equipped with support pins or claws 57 which can be employed for raising and lowering or for the initiation of a tilting motion with the assistance of a heavy hydraulic lifting unit for example. Disruptions at the nozzles occurring during operation can also be quickly and easily eliminated in these reactors 52, 53, which correspond in function to the afore-mentioned single and two-chamber reactors.

As is shown in FIG. 11, reactor 58 can very advantageously be equipped with a bottom in the form of a half cylinder 59, with a gas discharge nozzle 60 which is laterally displaced. The reactor 58 is equipped with bottom nozzles 67 which are arranged in the fireproof material 68 of the reactor. The half cylinder 59 is guided on rollers 69. This arrangement has the advantage that, given a swivel motion around the pivot M in accord with arrow 61, the nozzle 60 is swiveled toward the top and out of the seal 62 of the stationary gas discharge line 63.

FIG. 12 shows the seal 62 in an enlarged scale. Component parts identical to those in FIG. 11 are referenced with the same numbers. The gas discharge 60 dips into an annular channel 64 with a U-shaped cross-section. The seal between the U-shaped annular channel 64, which is tightly welded to the stationary gas line 63, and the edges 65 of the gas discharge nozzle 60 ensues by means of a pourable or a plastic sealing compound. The sealant is preferably a fill consisting of a heat resistant, pourable material such as ceramic sand, as indicated with number 66.

FIG. 13 shows a reactor 70 in horizontal construction. The cross-section of this reactor 70 can be seen from FIG. 14. In this case, the opening 71 for the discharge of the gases is arranged at one end at face 72. The opening 71 verges into an emission channel 73 which proceeds approximately horizontally, in which emission channel 73 the lower emission edge 74 rises at an angle $\alpha$ to the horizontal and its axis X—X preferably proceeds above the center line M—M of the reactor 70 and is laterally displaced with respect to reactor 70. The emission channel 73 of the reactor 70 is connected via a rotary seal 94 to the stationary gas discharge line 10 which is subsequently bent and exhibits a dust separator device 95.

At the end face 75 of the reactor 70 lying opposite the gas discharge channel 73, an opening 76 for the discharge of a liquid phase is arranged. At an interval from the bath surface 77, an opening 78 is arranged in the upper area of the reactor 70 and provided with a closure 79. This opening enables the filling of the reactor with the molten metal as well as for access during repair of the reactor in the cold state. A further opening 80 in the surface 81 (FIG. 14) serves for emptying the bath when the reactor 70 is in an emptying position, i.e. when tilted by 90°. The reactor 70 has two ball races 82 as a seat, which ball races rest on a respective guidance roller 83 and a running roller 84. For achieving a swivel motion, the reactor 70 can be provided in a known manner with a toothed segment and a pinion, as well as with an appropriate drive. As this is generally considered standard, a description of such a device has beem omitted. The opening 76 serves for the intermittent outflow of the layer of slag floating on the metal bath and is therefore normally hermetically sealed by means of a closure plug. From time to time, it is opened for the outflow of the excess slag and is then closed again. Therefore, this opening does not necessarily require a siphon-like closure. The product gas streams flows out of the reactor in the direction of arrow 88.

Figure 14:
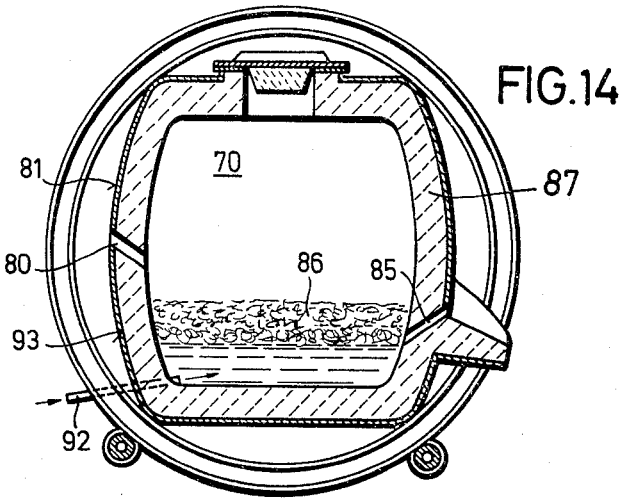
FIG. 14 is a cross-sectional view of a reactor according to FIG. 13.

In FIG. 14, the slag outflow opening is arranged as a channel 85 proceeding diagonally toward the top. This arrangement likewise serves for closing the opening due to the surfacing liquid, whereby slag only flows toward the outside after the layer of slag 86 has risen above the highest point of channel 85. The reactor 70 is fitted out with fireproof material 87.

Figure 15:
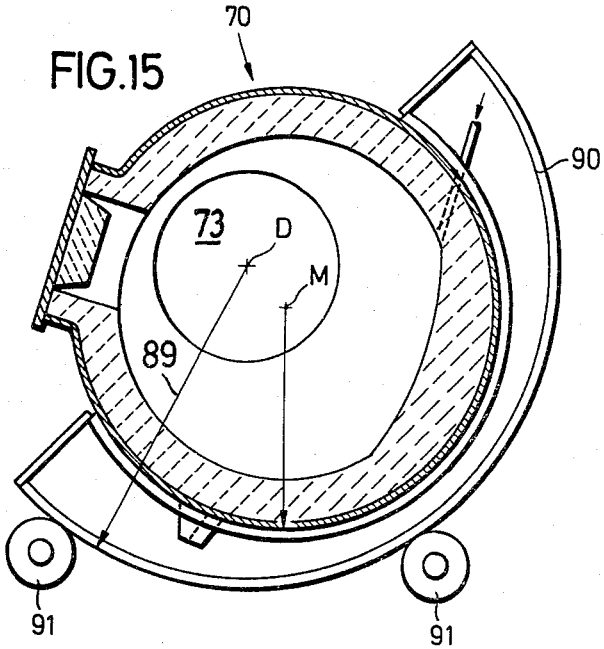
FIG. 15 is a cross-sectional view showing a reactor similar to FIGS. 13 and 14 and having a pivot lying in the axis of the emission channel.

FIG. 15 shows a particularly expedient arrangement in which the seating of the reactor 70, consisting of the ball race 90 and the running rollers 91 is undertaken in such a manner that the axis of the emission channel 73 proceeds concentrically to the pivot D of the seating, as is indicated by means of the radius vector 89. The center of the reactor 70 is referenced with M and, in its normal position, is situated below the axis X—X of the discharge channel 73. In this arrangement, there derives the significant advantage that the connection of the rotatable reactor 70 to a stationary gas line 10 can ensue with the assistance of a rotatable seal 94.

Figures 16, 17:
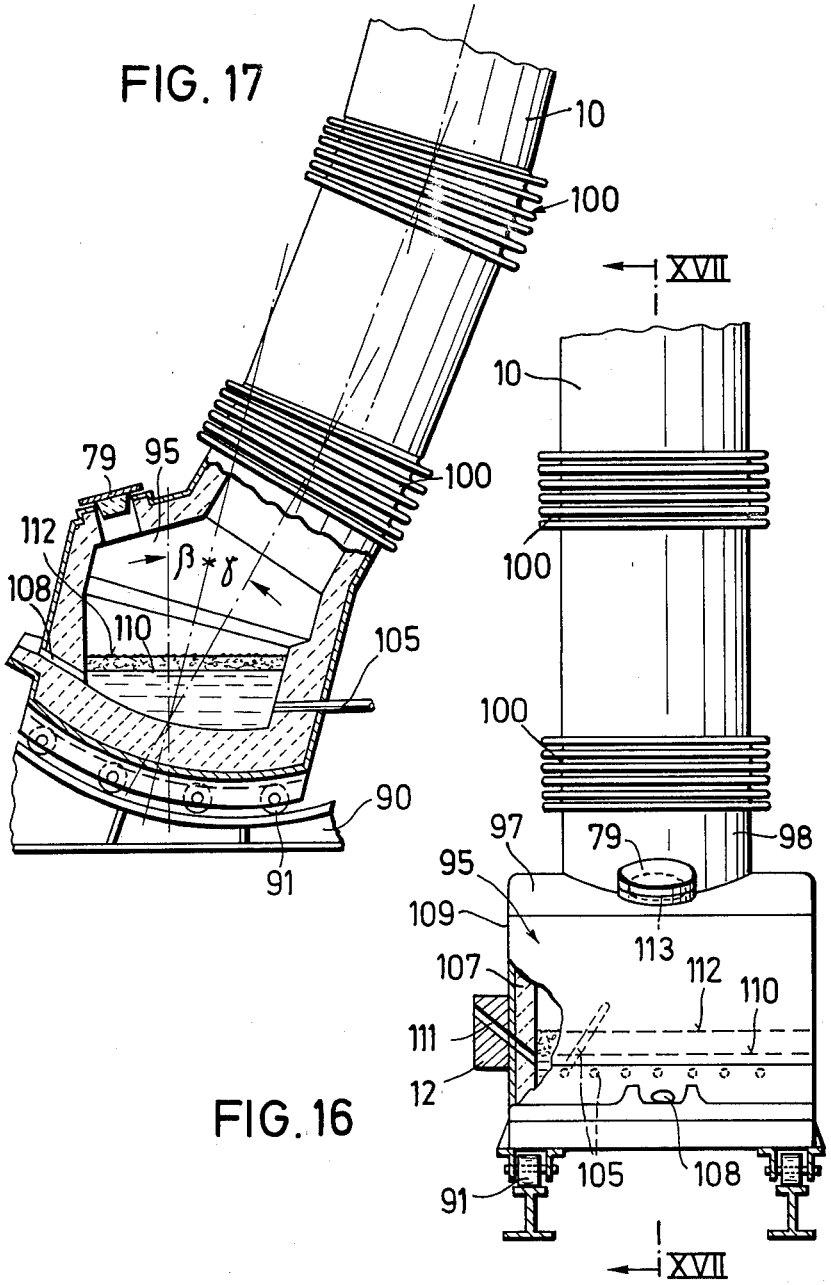
FIG. 16 is a side elevational view showing a reactor having a compensating seal at the reactor discharge.
FIG. 17 is a side elevational view with portions in section taken along the direction of arrow XVII in FIG. 16 showing the reactor in the blowing position.

FIG. 16 shows a reactor 95 in a vertical construction. The longitudinal section of this reactor is illustrated in FIGS. 17, 18 and 19. The reactor is connected to the stationary gas discharge line 10 via two compensator seals 100. The gas discharge channel 98 emerges from the reactor approximately in the middle, as shown in FIG. 16. The upper reactor wall 97 exhibits an opening 113 which can be closed off with a closure 79, which is provided. The opening 113 can serve for the intake of the molten metal. The discharge opening 111 for the liquid slag, which can be designed as a syphon, is provided in the side wall 109 of the reactor. In FIG. 16 the discharge opening 111 is located in a connection piece 12 which can be connected to a device, (not illustrated in greater detail), for the de-sulfurization and preparation of the slag, or which can be connected to a slag ladle.

An outflow opening 108 for the molten metal is situated in the bottom area of the reactor 95. The liquid level of the molten metal phase is indicated with the reference number 110 and the level of the slag phase is indicated with reference number 112. The nozzles 105 for the introduction of the gasification agents and slag-forming constituents when needed into the molten metal bath are situated on the rear end wall 106 (FIG. 18). Via running rollers 91, the reactor is tiltably seated on a ball race 90 foundation. Expediently, the reactor floor 114 exhibits a curvature which corresponds to the curvature of the ball race.

In longitudinal section, the reactor 95 essentially exhibits the form of a quadrangle inscribed within a circle. The opening 96 for the discharge of the product gases is located, laterally displaced, in the upper wall 97 of the reactor and extends toward the emission channel 98 which is in turn connected to an intermediate pipe 99 by means of a compensator seal 100. This intermediate pipe is then connected to the stationary gas discharge line 10 via a second compensator seal 100 (FIGS. 17 through 19).

The operating or blow position of the reactor 95 is illustrated in FIG. 17. The reactor 95 is swiveled around an angle $\beta$ with respect to the vertical axis Z—Z of the reactor 95 in the direction of the emission channel 98. In this position, with a given bath volume, the largest possible surface for the emergence of the product gases ensues but at the same time, the bath depth is designed so that the nozzles 105, through which the gasification materials and/or the slag-forming constituents are introduced into the metal bath, can be arranged at a sufficient depth in the rear end wall 106 of the reactor 95 that the direct blow-through of these substances through the bath can be avoided. Thereby, a complete conversion of the gasification agents can be guaranteed.

An intermediate position of the reactor is illustrated in FIG. 18, in which position the compensator seals 100 are unloaded of tension. It can be seen in this position that the axis y—y of the emission channel 98 is swiveled with respect to the vertical axis z—z of the reactor by an angle $\gamma$ (FIG. 17). In the unloaded position, the axes of the intermediate pipe 99 and of the stationary gas discharge line 10 align with the axis y—y of the discharge channel 98.

FIG. 19 shows the idle or servicing position of reactor 95, whereby the nozzles 105 are rotated out of the metal and slag bath and, in this position, can be serviced or replaced in a simple manner. In this reactor position, the compensator seals 100 are biased opposite to the reactor position according to FIG. 17. In this manner, angular loads of equal size to those derived for the compensator seals 100 between the working position of the reactor 95 according to FIG. 17 and the idle position according to FIG. 19 are obtained. The reactor 95 with compensator seals 100 is particularly suited for pressure operation.

Figure 20:
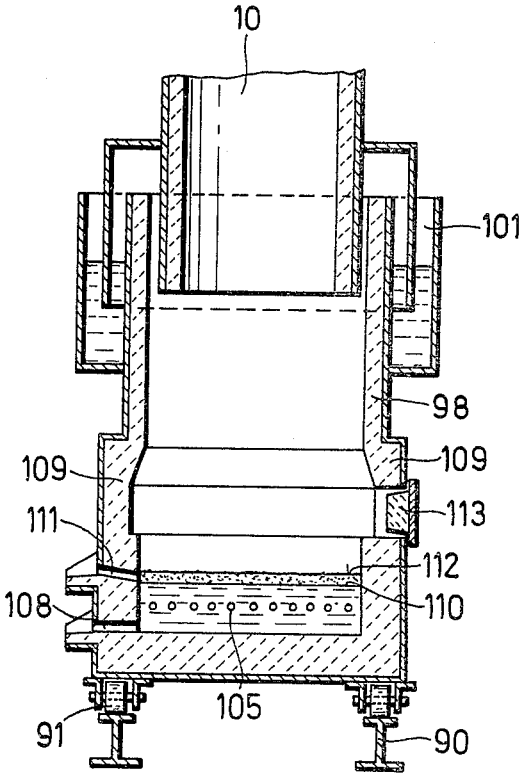
FIG. 20 is a side elevation sectional view showing a reactor with a sealing cone according to the present invention.
Figure 21:
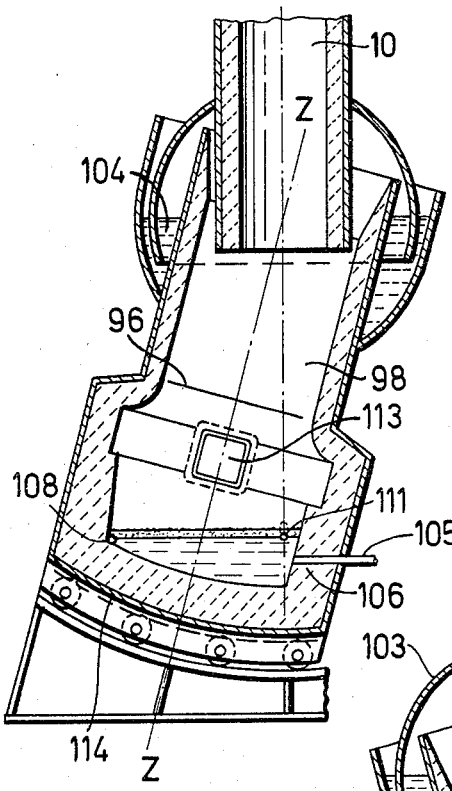
FIG. 21 is a view similar to FIG. 20 showing the reactor in the blowing position.
Figure 22:
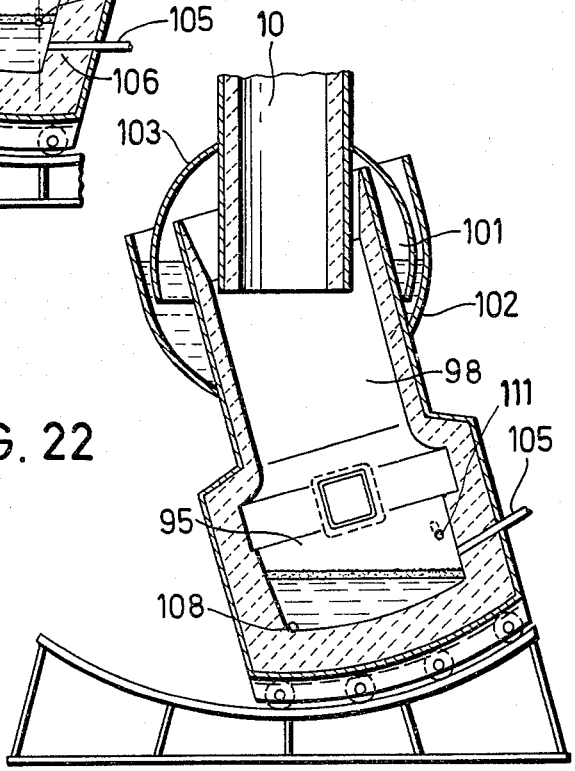
FIG. 22 is a view similar to FIG. 21 showing the reactor with nozzles swiveled out of the molten bath.

A vertical reactor with sealing cone as a gas seal between discharge channel 98 and stationary gas discharge line 10 is illustrated in FIGS. 20 to 22. This seal is particularly suited for a pressure-less (atmospheric pressure) operation of the reactor. In longitudinal section, the reactor is essentially of rectangular shape. Its end face 106 exhibits the gasification nozzles 105 in the wall area near the bottom. The intake opening 113 for the molten metallic phase is located in a side wall of the reactor. The slag discharge opening 111 and the discharge opening 108 for a metallic phase are arranged in the side wall 109 lying opposite this intake opening. The reactor is tiltably conducted on the running rollers 91 and the foundation 90. The reactor bottom 114 exhibits a curvature which corresponds to the curvature of the running foundation 90.

FIG. 21 shows the blow or operating position of the reactor in section. The reactor is swiveled in the direction of nozzles 105 such that a bath dimesion of the greatest possible surface for an optimum gas emergence and the greatest possible bath depth for a favorable nozzles arrangement ensue. The sealing cone 101 consists of a lower half-shell 102 which surrounds the emission channel 98. The second half-shell 103 of smaller diameter which surrounds the stationary gas discharge line 10 dips into this first half-shell 102 from above. The sealing cone 101 is filled with water to form a gas seal. FIG. 22 shows the idle position or the position for maintenance and repair of the nozzles 105, whereby the nozzles 105 have been rotated out of the metal and slag baths. In case a repair of the fireproof cladding material should be necessary in the reactor, a complete emptying of the reactor can occur in this reactor position.

While we have disclosed exemplary structures to illustrate the principles of the invention, it should be understood that we wish to embody within the scope of the patent warranted hereon all such modifications as reasonably and properly come within the scope of our contribution to the art.

We claim as our invention:

1. In a device for the gasification of carbon containing materials for the continuous production of carbon monoxide and hydrogen gases of the type in which the carbon materials and any oxidizing agents and slag-forming constituents required are supplied through inlets located below the surface of a molten metal bath in a reactor, with at least one opening in the reactor provided for the release of the gases produced and an opening for discharging slag, the improvement comprising:

said reactor having a partition wall defining two chambers in said reactor, said partition wall having an opening therein connecting said two chambers, said opening permitting passage of a liquid phase from a first chamber to a second chamber;

a gas seal in the form of a syphon in said opening in said partition wall;

said inlets for the carbon material, oxidizing agents, and slag-forming materials being nozzles disposed in a lower portion on one side of said reactor;

a gas discharge element removably attached to one of said openings for the release of gases in the reactor for retrieving said gases;

a stationary gas discharge line receiving the gases from said gas discharge element;

a releaseable means for normally sealing connecting said gas discharge element to said stationary gas discharge line and to said opening for the release of gases;

an opening for discharging a liquid phase of said molten metal bath from said reactor, said opening disposed in an end wall of said reactor;

a further opening in said reactor having a removable closing means disposed above the surface of said molten metal bath for filling said reactor with molten metal and for repair access; and means supporting said reactor permitting angular movement about a horizontal axis, said releasable means permitting said reactor to be tilted, swiveled, or rotated about said horizontal axis without breaking the seal between said opening for the release of gases and said stationary gas discharge line to alter the position of the molten metal bath in the reactor without discharge thereof, for exposing portions of the inside reactor surface including said nozzles normally positioned beneath the surface of the metal bath during gasification operation for replacing and cleaning thereof.

2. The improvement of claim 1 wherein said second chamber further comprises a means for the introduction of a gas therein, said gas being selected from the group consisting of oxygen, hydrogen, and a mixture of oxygen and hydrogen.

3. The improvement of claim 1 wherein said reactor is of a shape such that the depth of said molten metal bath is a maximum for a selected amount of molten metal such that no blow-through of a gasification agent or of a slag-forming constituent to the surface of said molten metal bath takes place and wherein said reactor is in longitudinal section in the form of a quadrangle inscribed within a circle.

4. The improvement of claim 1 wherein said reactor is of a shape such that the depth of said molten metal bath is a maximum for a selected amount of molten metal such that no blow-through of a gasification agent or of a slag-forming constituent to the surface of said molten metal bath takes place and wherein said reactor is trapezoidal in longitudinal section.

5. The improvement of claim 1 wherein said opening for the release of said gases is disposed in an end wall of said reactor opposite to said end wall containing said opening for discharging said liquid phase, and wherein said gas discharge element is a gas discharge channel communicating with said opening for the release of said gases and with said stationary gas discharge line, and wherein said releasable means for normally sealingly connecting said gas discharge element is a rotary seal, said gas discharge channel having a lower edge which rises at an angle to said gas discharge channel horizontal axis.

6. The improvement of claim 5 further comprising a gas discharge shaft interconnected between said gas discharge channel and said stationary gas discharge line, said gas discharge shaft extending laterally from the horizontal axis of angular movement for the reactor and having an end portion which is received in a stationary gas discharge line seal.

7. The improvement of claim 6 wherein said stationary gas discharge line seal comprises:

a U-shaped annular channel attached to said stationary gas discharge line;

an end portion of said discharge shaft which is received in said annular channel; and a sealant contained within said annular channel surrounding said end portion of said discharge shaft, said sealant being selected from the group of sealants consisting of water and sand.

8. The improvement of claim 1 wherein said opening for the release of gases is disposed in an upper wall of said receiver and is laterally displaced in longitudinal section of said reactor and wherein said gas discharge element contains at least one flexible compensator connection permitting a limited amount of angular movement of said reactor.

9. The improvement of claim 1 wherein said opening for the release of gases is disposed in an upper wall of said reactor and is laterally displaced in longitudinal section of said reactor and wherein said means for connecting said gas discharge element to said stationary gas discharge line is a sealing cone comprising:

a spherical half-shell open at the top end surrounding and sealed to said gas discharge element, forming a U-shaped annulus;

a second half-shell attached to and surrounding said stationary gas discharge line and received in said U-shaped annulus; and a sealant contained within said U-shaped annulus selected from the group of sealants consisting of water and sand.

10. The improvement of claim 1 wherein said inlets are nozzles and are disposed at a bottom of an end wall of said reactor, said end wall containing said nozzles also containing said opening for the release of gases.

11. The improvement of claim 10 further comprising an opening in an end wall of said reactor opposite said end wall containing said nozzles for discharging a liquid phase from said reactor, said opening for discharging a liquid phase being disposed at a bottom of the end wall containing said liquid phase discharge opening.

12. The improvement of claim 10 wherein said opening for discharging slag is disposed in a side wall above said molten metal bath level and wherein said opening for discharging slag is provided with a gas seal in the form of a syphon.

13. The improvement of claim 12 wherein said opening for discharging slag is positioned in said side wall such that said opening remains covered by said slag during angular movement of said reactor.

14. The improvement of claim 1 wherein said opening for the release of gases is disposed in an upper wall of said reactor and wherein said reactor is angularly movable in the direction of said opening for the release of gases with respect to the vertical axis of said reactor, and wherein the bottom of said reactor is curved.

* * * * *